US010557271B2

(12) United States Patent
Olvey et al.

(10) Patent No.: US 10,557,271 B2
(45) Date of Patent: Feb. 11, 2020

(54) SIDING HAVING A STAPLE HEM

(71) Applicant: Royal Building Products (USA) Inc., Columbus, OH (US)

(72) Inventors: Patrick Olvey, Columbus, OH (US); Chris J. Johnson, Columbus, OH (US)

(73) Assignee: ROYAL BUILDING PRODUCTS (USA) INC., Columbus, OH (US)

( * ) Notice: Subject to any disclaimer, the term of this patent is extended or adjusted under 35 U.S.C. 154(b) by 0 days.

(21) Appl. No.: 15/274,776

(22) Filed: Sep. 23, 2016

(65) Prior Publication Data

US 2017/0089077 A1 Mar. 30, 2017

Related U.S. Application Data

(60) Provisional application No. 62/232,180, filed on Sep. 24, 2015.

(51) Int. Cl.
*E04F 13/08* (2006.01)

(52) U.S. Cl.
CPC ..... *E04F 13/0864* (2013.01)

(58) Field of Classification Search
CPC ..... E04F 13/0864
See application file for complete search history.

(56) References Cited

U.S. PATENT DOCUMENTS 5,651,227 A * 7/1997 Anderson ..... E04F 13/0864 52/519
5,768,844 A * 6/1998 Grace, Sr. ..... E04F 13/18 52/529
5,806,185 A * 9/1998 King ..... B29C 47/003 264/146
5,878,543 A * 3/1999 Mowery ..... E04F 13/0864 52/519
5,946,876 A * 9/1999 Grace, Sr. ..... E04D 3/32 52/520
6,050,041 A * 4/2000 Mowery ..... E04F 13/18 52/506.05
6,341,463 B1 * 1/2002 Dickey ..... E04F 13/0864 52/521
6,363,676 B1 * 4/2002 Martion, III ..... E04F 13/0864 52/519
6,370,832 B1 * 4/2002 McGarry ..... E04F 13/0864 52/520

(Continued)

OTHER PUBLICATIONS

Ryobi Tools, Operator's Manuel 12 Volt Auto Hammer, Nov. 2009, 1-24, One World Technologies, Inc., USA.

*Primary Examiner* — Babajide A Demuren
(74) *Attorney, Agent, or Firm* — Standley Law Group LLP; Jeffrey Standley; Jeffrey Norris

(57) ABSTRACT

A siding panel having a staple hem with at least one slotted hole or other aperture configured to accommodate a free-floating staple. An added thickness portion extends from and overlaps a portion of the staple hem and is configured to limit the depth the staple may penetrate into the aperture. A tongue extends from and below the staple hem and is configured to accommodate a corresponding groove. At least one exterior panel or other configuration extends below and from the tongue. In an exemplary embodiment, a groove configured to mate with a corresponding tongue extends from the last exterior panel.

18 Claims, 9 Drawing Sheets

(56) References Cited

U.S. PATENT DOCUMENTS

| | | | | |
|---|---|---|---|---|
| 6,647,687 | B2 * | 11/2003 | Kern | E04F 13/0864 52/233 |
| 7,980,038 | B2 * | 7/2011 | O'Neal | E04F 13/0864 52/551 |
| 8,381,472 | B1 * | 2/2013 | Fleenor | E04F 13/0825 52/459 |
| 2002/0029537 | A1 * | 3/2002 | Manning | E04F 13/0864 52/518 |
| 2005/0081468 | A1 * | 4/2005 | Wilson | E04F 13/007 52/528 |
| 2005/0193674 | A1 * | 9/2005 | Hatkoff | E04F 13/0864 52/561 |
| 2005/0246996 | A1 * | 11/2005 | Ptak | F16B 15/00 52/520 |
| 2010/0175341 | A1 * | 7/2010 | Gilbert | B32B 5/18 52/302.1 |

* cited by examiner

DETAIL A
SCALE 2 : 1

SIDING HAVING A STAPLE HEM

This application claims the benefit of U.S. Provisional Application No. 62/232,180, filed Sep. 24, 2015, which is hereby incorporated by reference in its entirety.

BACKGROUND AND SUMMARY OF THE INVENTION

Exemplary embodiments of the present invention relate generally to siding.

Relatively rigid building panels, such as siding panels, are typically adapted to be attached to a wall of a building or other underlying structure. The siding panels may provide protection from the elements as well as aesthetic design. While traditionally extending horizontally, they may extend vertically as well. The siding panels may be provided in a number of colors and shapes, though they are frequently configured to simulate wood siding. The panels are often configured to overlap or interlock with one another. One edge, such as an upper edge of the panel, may provide an attachment point.

Nails or other fasteners are often used to attach the siding panels to a wall. Thus, siding has typically been configured to accommodate only nails or both nails and other fasteners. However, siding panels so configured require differently sized and located features that are not optimized for staples. Therefore, there is a need for siding that is configured specifically to accommodate staples.

Exemplary embodiments of the present invention comprise a siding panel configured and optimized to accommodate staples. In an exemplary embodiment, the siding panel comprises a staple hem having at least one slotted hole or other suitably shaped aperture. The aperture(s) are configured to accommodate the staple(s), which may be adapted to attach the siding to a wall while permitting the expansion and contraction of the siding panel due to fluctuations in temperature. An exemplary embodiment of the siding panel may further comprise an added thickness portion configured to uniformly space the staple from the staple hem, thereby permitting the staple to be driven flush with the added thickness portion but still allow room for expansion and contraction as well as air circulation and drainage. In other embodiments, the added thickness portion may be configured to uniformly space the siding panel from a wall, thereby permitting the staple to be driven flush with the siding panel but still allow room for expansion and contraction as well as air circulation and drainage.

Below the staple hem, the siding may have a tongue configured to receive and mate with a corresponding groove of a second siding panel. Below the tongue may extend any number of exterior panels (e.g., rows) or other configurations. For example, the exterior panels may be configured to simulate wood siding. In an exemplary embodiment, following the last exterior panel or at another suitable portion of the panel, a groove may extend which is configured to attach to and mate with a corresponding tongue of another siding panel and thus allow the panels to interlock.

Compared to a traditional siding panel having a nailing hem, an exemplary embodiment of the staple hem may be shorter, and the aperture(s) may be smaller. In an exemplary embodiment, an added thickness portion may also be shorter, and the distance between the slotted hole of the staple hem and the tongue may be reduced.

In an exemplary embodiment, the shorter staple hem and added thickness portion may effectively reduce the distance between anchor points of a siding panel, while allowing the exposed portion of the siding panel to maintain the same width. This may reduce the possible deflection of the panel under wind loading and eliminate excess material. Additionally, this configuration may provide extra clearance between the upper edge of the added thickness portion and the upper leg of the staple, thereby providing additional clearance for installation and a lower risk of damaging the siding panel during installation.

Further, an exemplary embodiment of the shorter staple hem may reduce the distance between the aperture(s) of the staple hem and the tongue. This may allow the installer to use the tongue as a guide and thus more efficiently locate the stapling device, thereby reducing the effort required for installation. Finally, the aperture(s) of the staple hem may be reduced in size to accommodate the staples, such that the staples may be installed with an optimized amount of free-float for expansion and contraction of the siding. Also, material may be saved, and less cutting may be required and/or less material may need to be removed to form the aperture(s).

In addition to the novel features and advantages mentioned above, other benefits will be readily apparent from the following descriptions of the drawings and exemplary embodiments.

DETAILED DESCRIPTION OF EXEMPLARY EMBODIMENT(S)

Exemplary embodiments of the present invention are directed to siding, such as made from "vinyl" materials including, but not limited to, polyvinylchloride (PVC). It should be recognized, however, that exemplary embodiments of the present invention also include siding panels made from other materials. For example, a siding panel of the present invention may be made from any suitable material including, but not limited to, metals, woods, synthetic wood composites, and other plastics. Other plastics may include, but are not limited to, polystyrene, acrylonitrile-butadiene-styrene (ABS), nylon, ethylene-vinyl acetate (EVA), polycarbonate, polyethylene (PE), polypropylene (PP), polyethylene terephthalate (PET), thermoplastic olefins, acrylonitrile-styrene-acrylic (ASA), and alloys, blends, and coextrusions of these or other resins.

Figure 1:
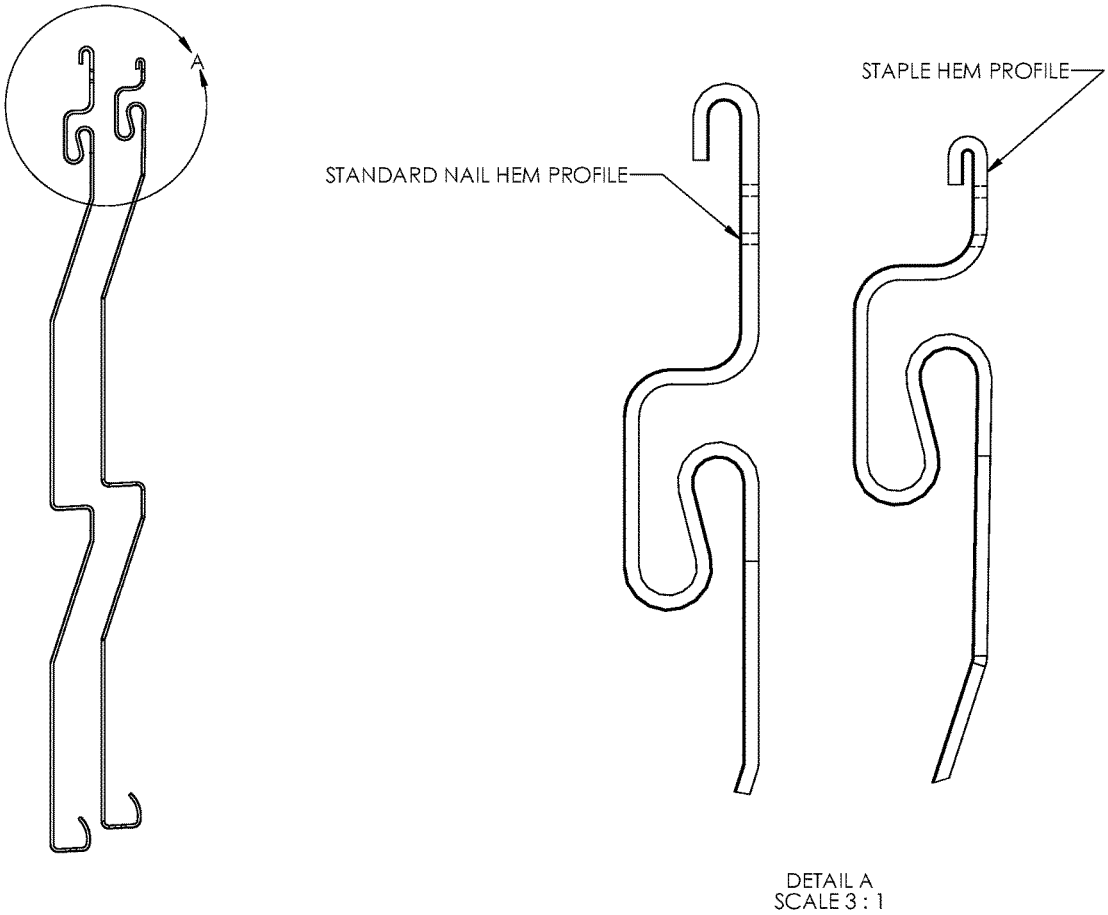
FIG. 1 is a side elevation view of an exemplary siding panel, additionally indicating Detail A.
Figure 2:
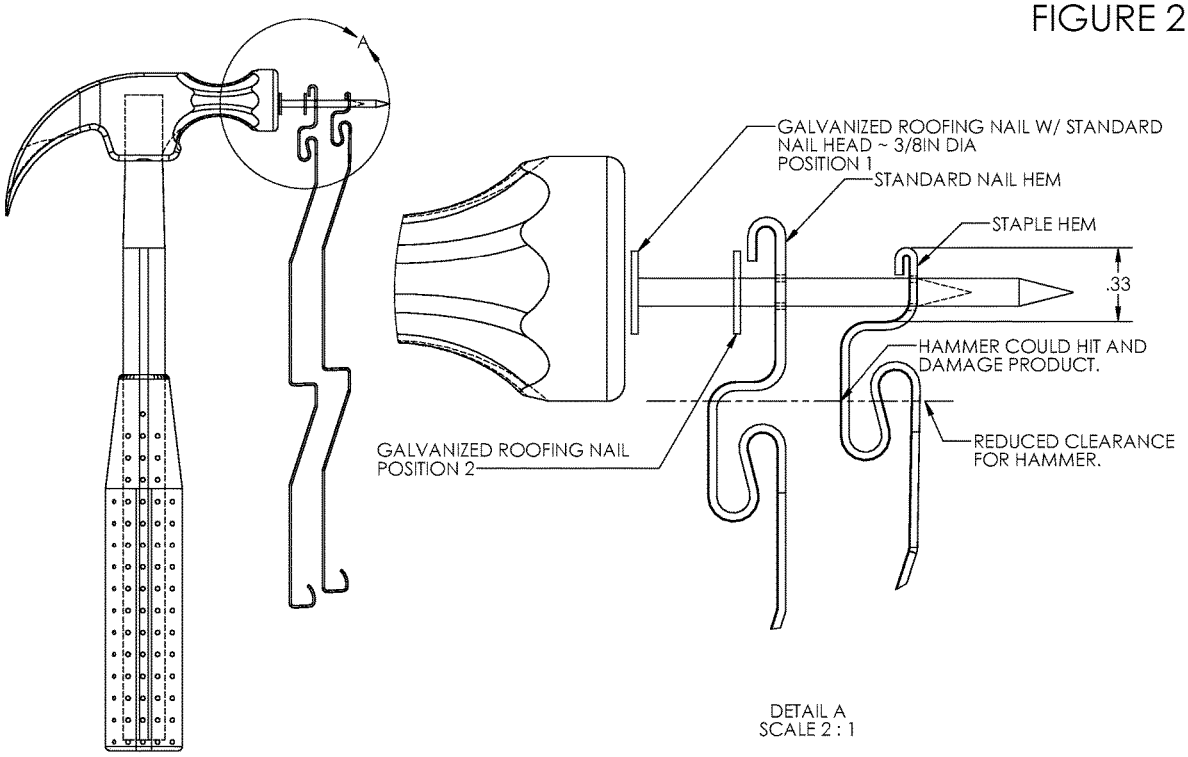
FIG. 2 is a side elevation view of Detail A of FIG. 1 (illustrated with a staple in an installed position).

FIG. 1 and FIG. 2 illustrate an exemplary siding panel 5. The siding panel 5 may be configured to interlock with other such siding panels 5. The interlocking may be accomplished, for example, by a tongue 20 configured to correspond and mate with a corresponding groove 35 of another panel. The tongue 20 may comprise a folded over section of siding configured to form a slot or channel 21, which accommodates the corresponding groove 35. An example of the tongue 20 may be generally S-shaped, such that it forms the slot 21 in the empty space between the curves of the S. An example of the groove 35 may be in the form of a J-shaped channel. A curved portion (i.e., a distal portion) of the J-shape may be configured to extend into the slot 21 of another panel when the siding panels 5 are interlocked.

In an exemplary embodiment, the siding panel 5 may further comprise an upper exterior panel 25 and a lower exterior panel 30. Such panels may also be referred to as a course or courses. These exterior panels 25 and 30 may generally be the portion of siding panel 5 that remains visible after installation. The exterior panels 25 and 30 may be configured to simulate wood siding, though any shape is contemplated. It is notable that while the present embodiment is illustrated with two exterior panels, 25 and 30, any number of exterior panels is contemplated. Likewise, any shape and design of the exterior panels 25 and 30 as well as any other configuration (e.g., shake siding) is contemplated.

FIG. 2 illustrates a detailed view of a portion of the siding panel 5. The siding panel 5 may further comprise a staple hem 15. An example of staple hem 15 may extend from tongue 20. In an exemplary embodiment, the tongue 20 may be configured such that the upper exterior panel 25, the lower exterior panel 30, and the staple hem 15 are substantially in line.

The staple hem 15 may comprise at least one aperture 70 (e.g., a slotted hole) sized to accommodate a staple 105. In this example, the siding panel 5 is illustrated with a staple 105 in an installed position, such that the lower leg of staple 105 protrudes through the aperture 70 and the crown of staple 105 rests against an added thickness portion 10 of siding panel 5. An example of the added thickness portion 10 may be C-shaped such that it folds over a portion of the front of staple hem 15. In such an embodiment, the added thickness portion 10 may be considered to extend from or be a portion of staple hem 15. In other embodiments, an added thickness portion 10 may be any other shape or design such that it adds a desired thickness to the portion of staple hem 15. In an exemplary embodiment, the added thickness portion 10 may be configured such that it prevents the staple 105 from being driven flush against or through the staple hem 15 and may also provide uniform spacing of the staple 105 from the wall.

In other embodiments, the added thickness portion 10 may fold behind or otherwise add a desired thickness to the section of the siding panel 5 behind the staple hem 15 such that the staple 105 rests substantially flush with the staple hem 15 but the staple hem 15 is spaced away from the wall by the added thickness portion 10. In such an embodiment, the added thickness portion 10 may provide uniform spacing of the siding panel 5 from the wall. Furthermore, in an exemplary embodiment, the upper leg of the staple 105 may be installed directly into the wall behind the siding panel 5. Other exemplary embodiments may not have an added thickness portion or may instead have a thicker staple hem (relative to the typical thickness of the siding panel).

The entire siding panel 5 may be formed from one piece of material such as by extrusion or molding. In other embodiments, the siding panel 5 may be comprised of initially separate pieces of material that are fused or otherwise joined together to form the panel.

Figure 3:
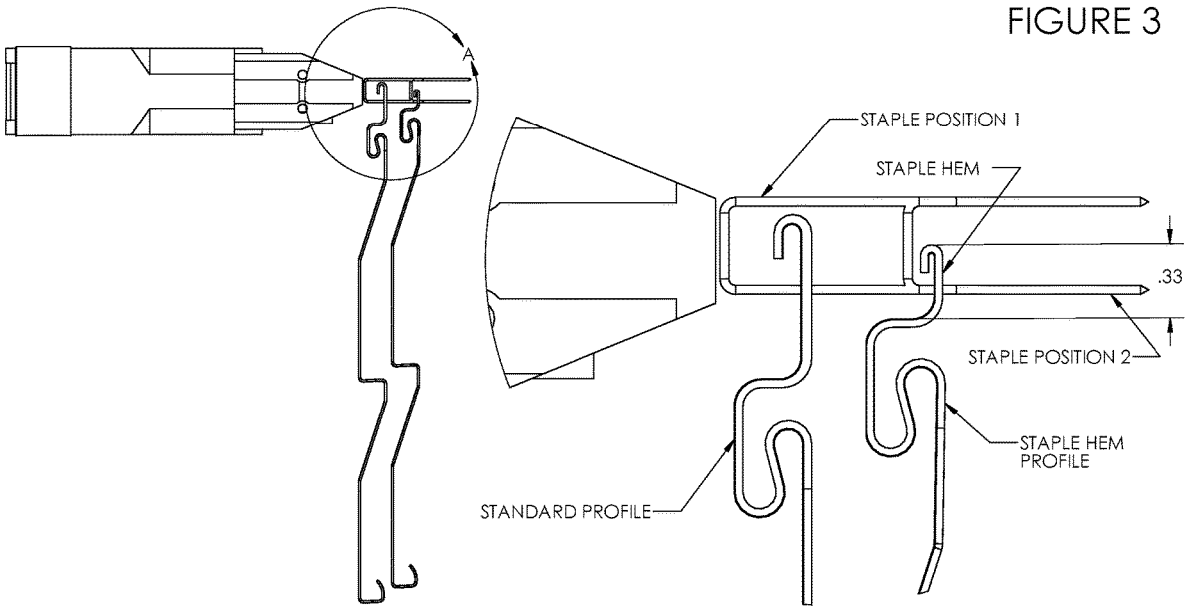
FIG. 3 is a side elevation view of the siding panel of FIGS. 1 and 2 juxtaposed with a traditional siding panel configured to accommodate a nail, additionally indicating Detail B.
Figure 4:
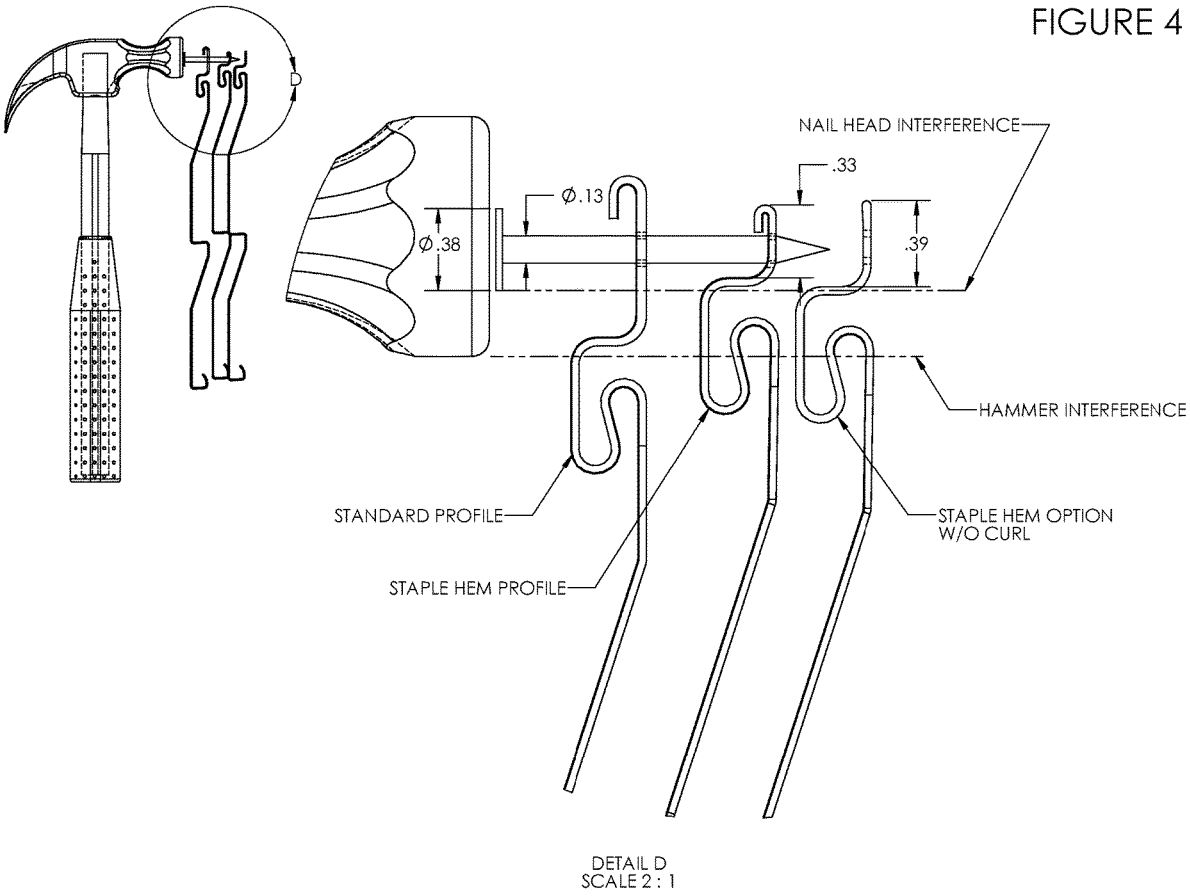
FIG. 4 is a side elevation view of Detail B of FIG. 3.

FIG. 3 and FIG. 4 illustrate the siding panel 5 of FIGS. 1 and 2 juxtaposed with an exemplary standard siding panel 110 configured for use with nails. It is notable that the standard siding panel 110 is merely illustrative and shown to highlight some of the inventive aspects of the siding panel 5. The differences discussed are merely exemplary and are not intended to be limiting. Those skilled in the art will appreciate that there may be many differences between the exemplary standard siding panel 110 and other known siding panels when compared to embodiments of the present invention.

For example, the added thickness portion 10 of the siding panel 5 may be shorter than a corresponding added thickness portion 40 of the standard siding panel 110. The staple hem 15 of the siding panel 5 may also be shorter than the nail hem 45 of the standard siding panel 110. For instance, in one embodiment, staple hem 15 may be less than 10 mm in length. Additionally, the upper edge of the aperture 70 of the siding panel 5 may be closer to the lower edge of the added thickness portion 10, and the lower edge of the aperture 70 may extend closer to the upper edge of the tongue 20. The upper edge of the aperture 90 of the standard siding panel 110, on the other hand, begins further from the lower edge of the added thickness portion 40. Likewise, the lower edge of the aperture 90 is located further from the upper edge of the tongue 50 in order to allow room for a hammer to strike a nail. In addition, due to a shorter staple hem 15, the overall length of siding panel 5 may be shorter than the standard siding panel 110, even though the exterior panels 25 and 30 of the siding panel 5 may be the same size and shape as the exterior panels 55 and 60 of the standard siding panel 110. In an exemplary embodiment, staple hem 15 may also be much shorter (lengthwise) than tongue 20, in contrast to siding panel 110 where nail hem 45 is significantly longer (lengthwise) than tongue 50 in order to accommodate a hammer. These differences are further illustrated in FIGS. 5-8.

Figure 5:
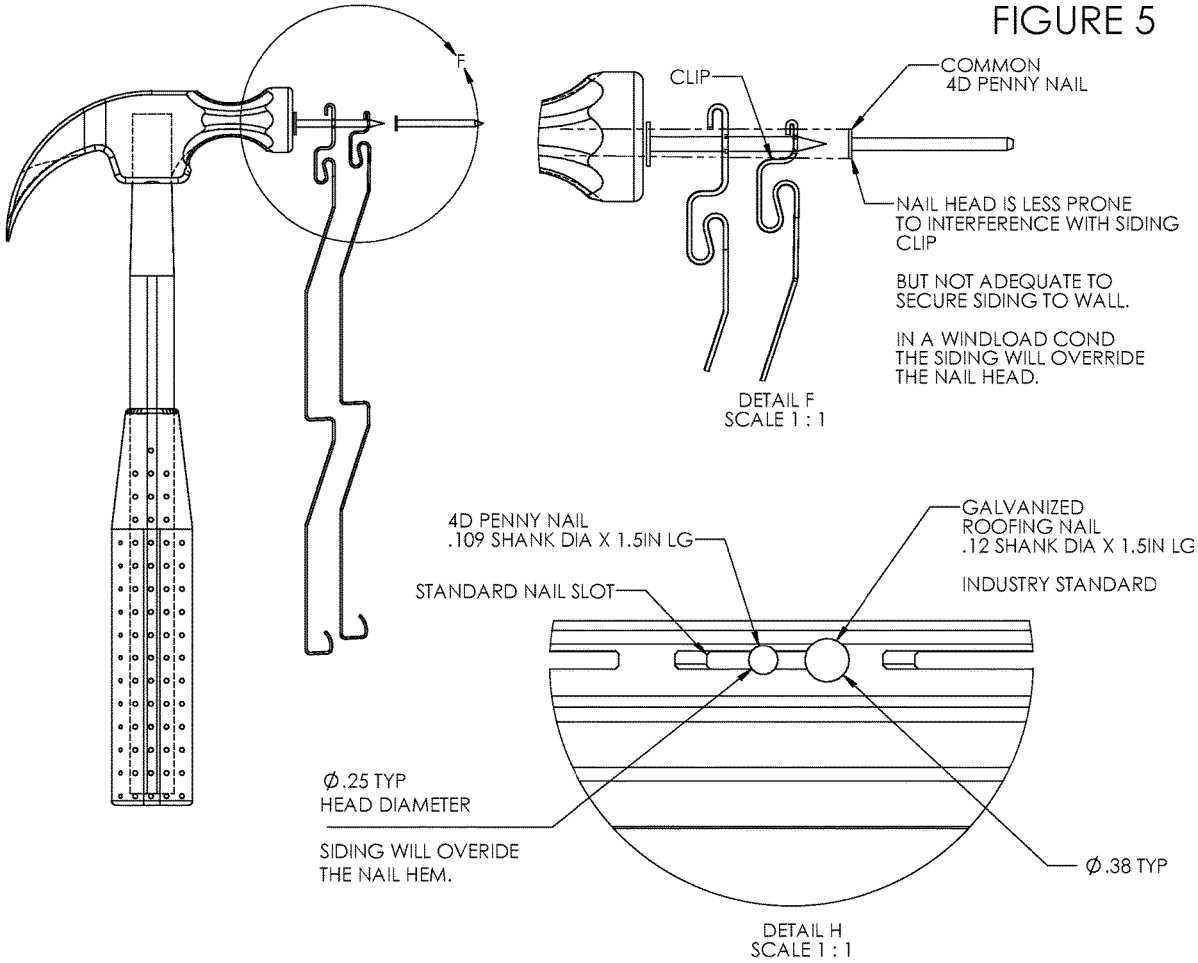
FIG. 5 is a side elevation view similar to FIG. 3, additionally illustrating an exemplary relationship of a hammer and a nail relative to the respective panels, and further indicating a Detail C.
Figure 6:
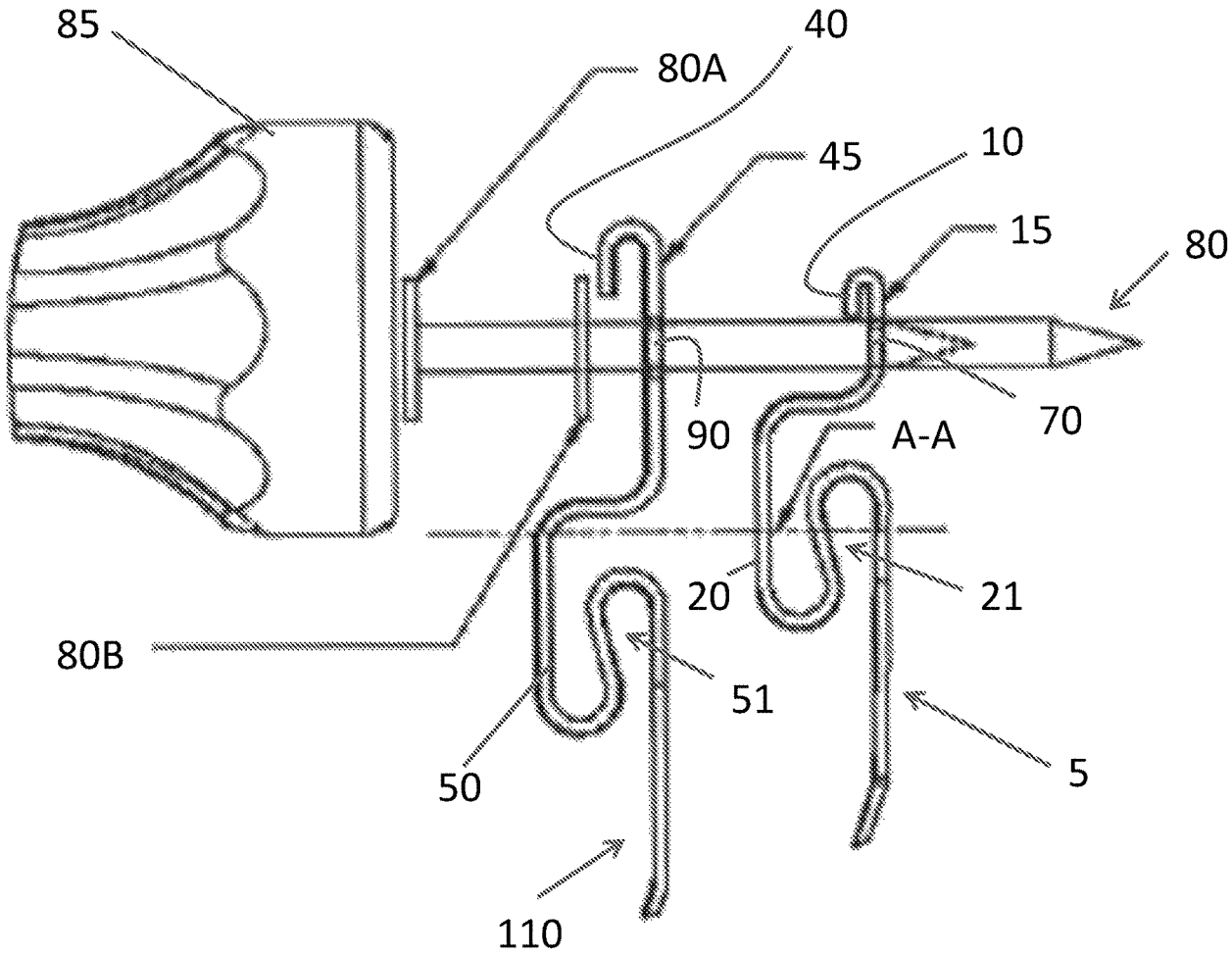
FIG. 6 is a side elevation view of Detail C of FIG. 5.

FIG. 5 and FIG. 6 illustrate an example of a hammer 85 and a nail 80 for attaching the standard siding panel 110 (or the siding panel 5 for exemplary purposes) to the wall. The hammer 85 moves the nail 80 from an uninstalled position 80A wherein the nail 80 has not reached a proper depth (relative to siding panel 110), to an installed position 80B wherein the head of the nail 80 has made contact with the added thickness portion 40 of the standard siding panel 110 and thus reached the proper depth. The standard siding panel 110 requires a gap between the upper edge of the aperture 90 and the lower edge of the added thickness portion 40 to accommodate passage of the nail 80. As illustrated in FIG. 6, imaginary line A-A extends from the bottom edge of the striking face of the hammer 85, which shows that the tongue 50 of the standard siding panel 110 must be placed lower than the tongue 20 of the siding panel 5 to accommodate the swing of the hammer 85 and the nail 80 (i.e., nail hem 45 of siding panel 110 must be longer). Additionally, the aperture 70 of the siding panel 5 may be smaller than the aperture 90 of the standard siding panel 110 as the aperture 70 of the siding panel 5 is configured to accommodate a staple 105 instead of a nail 80.

Figure 7:
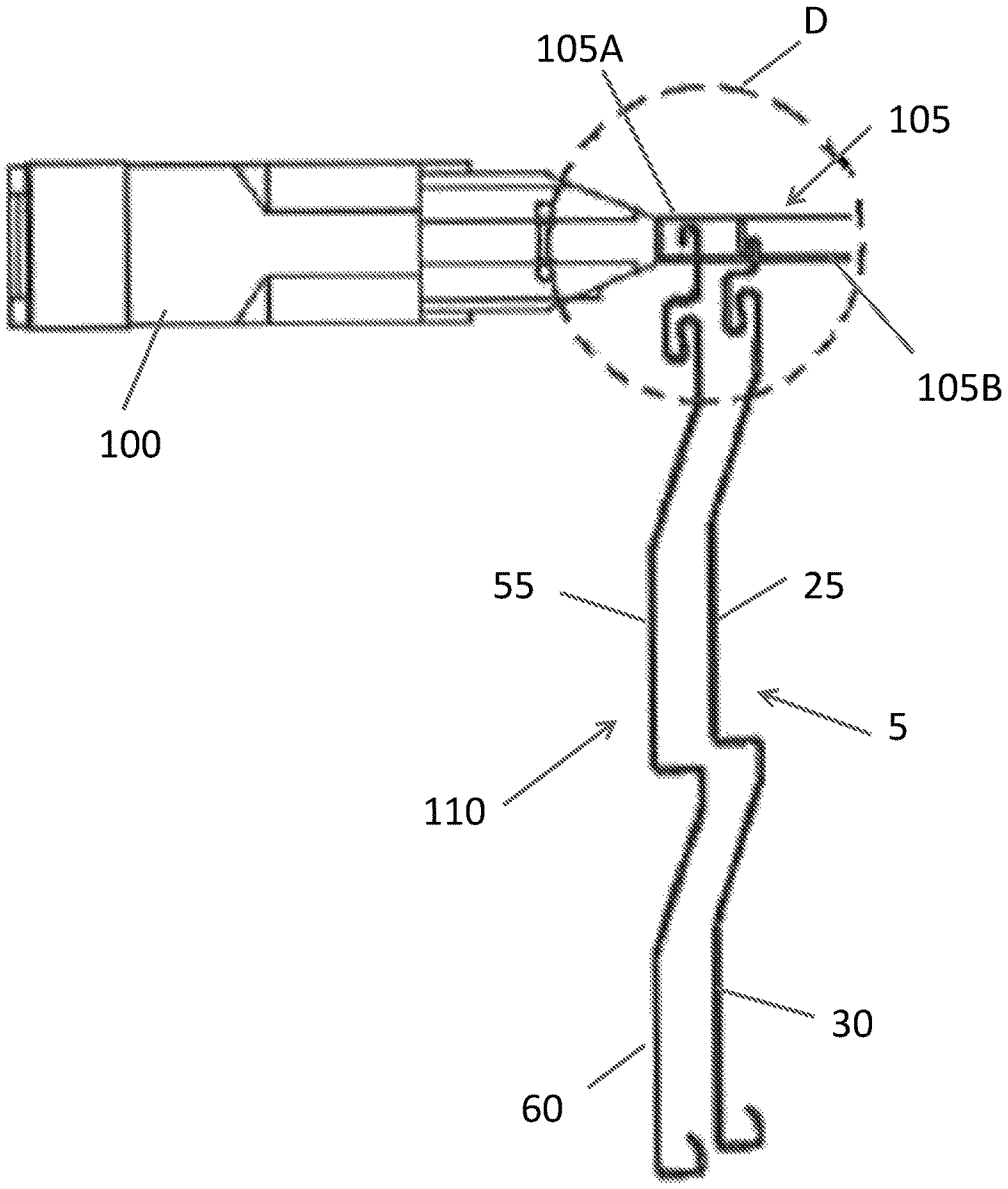
FIG. 7 is a side elevation view similar to FIG. 5, except in this instance illustrating an exemplary relationship of a staple device and a staple relative to the respective panels, and further indicating a Detail D.
Figure 8:
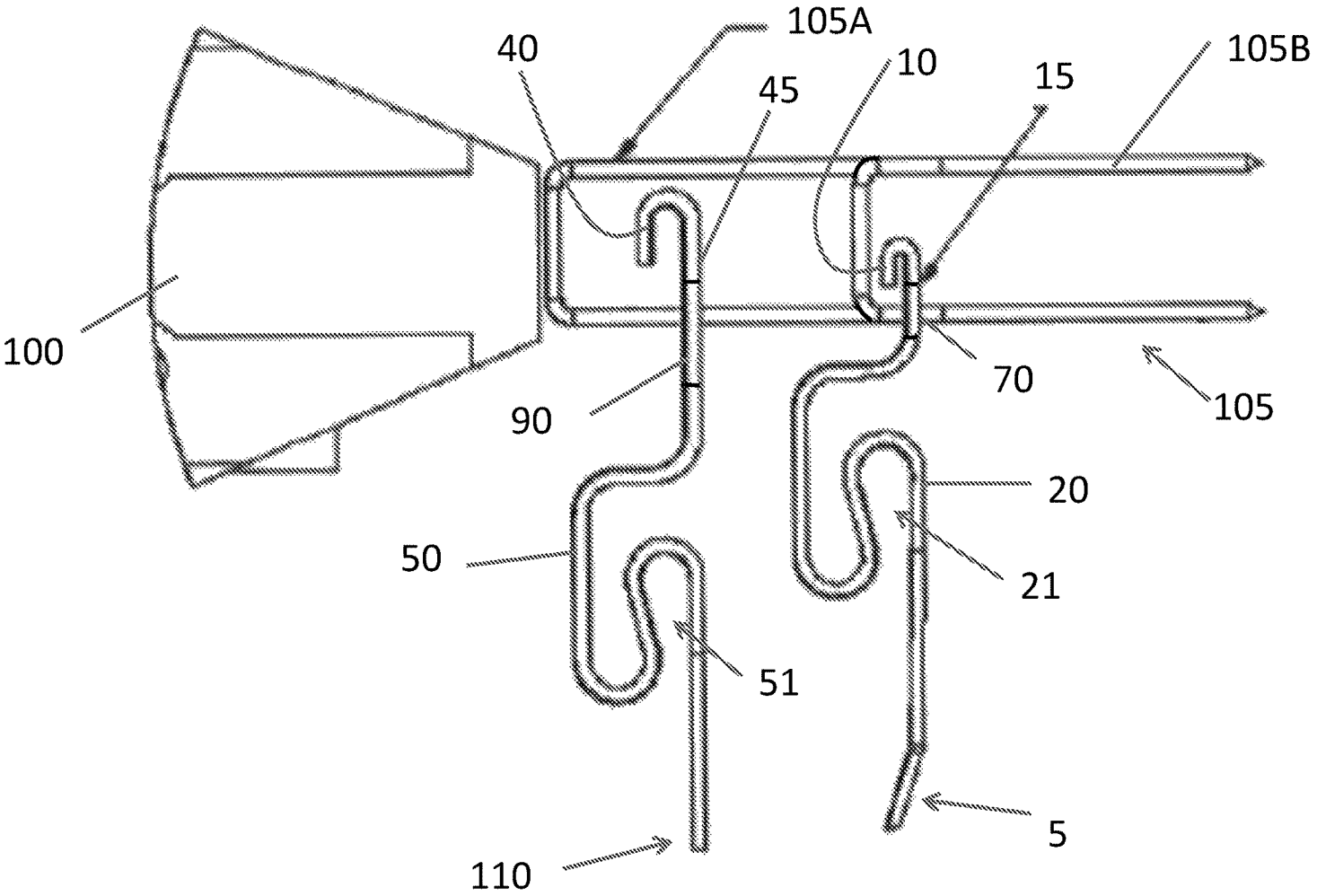
FIG. 8 is a side elevation view of Detail D of FIG. 7.

FIG. 7 and FIG. 8 illustrate an example of a staple device 100 and a staple 105 for attaching the siding panel 5 (or siding panel 110 for exemplary purposes) to a wall. The staple device 100, such as a stapler, staple gun, or the like, moves the staple 105 from an uninstalled position 105A wherein the staple 105 has not reached a proper depth (relative to siding panel 5), to an installed position 105B wherein the staple 105 has made contact with the added thickness portion 10 of the siding panel 5 and thus reached the proper depth. The staple 105 may be installed such that the lower leg of the staple 105 penetrates the aperture 70 and the upper leg of the staple 105 penetrates the wall above the siding panel 5. Therefore, in an exemplary embodiment, the added thickness portion 10 of the siding panel 5 may be any length so long as it does not cover the slotted hole 70, because when staple 105 is in the shown position the crown of the staple contacts the added thickness portion 10. However, in some embodiments, a staple may instead be installed in a generally horizontally manner such that an upper portion of the staple does not extend above the siding panel.

The staple hem 15 may be shorter than the nail hem 45, as less room is required for installation of a staple by the staple device 100. Consequently, the tongue 20 of siding panel 5 may be located closer to the aperture 70 of staple hem 15 than the tongue 50 of the standard siding panel 110 is to the aperture 90 of nail hem 45 in order to allow for a hammer strike and nail head. For similar reasons, aperture 70 of staple hem 15 may be located closer to added thickness portion 10 as compared to the distance between aperture 90 and added thickness portion 40 of standard siding panel 110.

Again, it is notable that the standard siding panel 110 shown in FIGS. 3-8 is merely illustrative and shown to highlight some of the inventive aspects of the siding panel 5. The differences discussed are merely exemplary and are not intended to be limiting. Those skilled in the art will appreciate that there are many differences between the exemplary standard siding panel 110 and other known siding panels when compared to an embodiment of the present invention, including exemplary siding panel 5.

Figure 9:
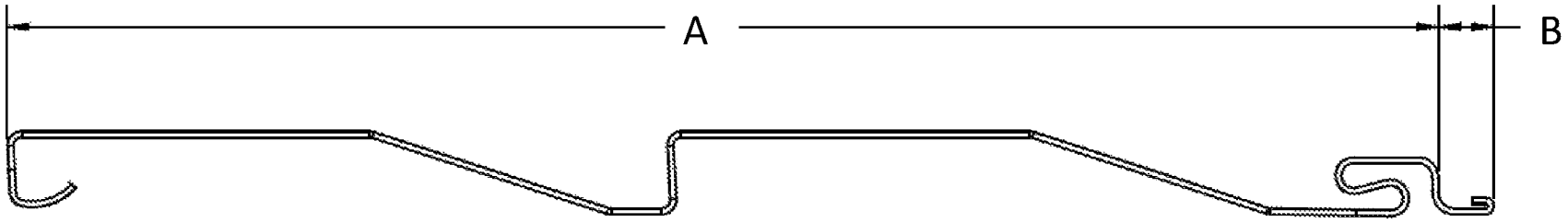
FIG. 9 is a side elevation view of another exemplary embodiment of the present invention with dimension lines to indicate exemplary dimension measurements.

FIG. 9 shows a side view of an exemplary embodiment of the present invention with exemplary dimension lines. In this example, dimension line A may have a length of 8.68 inches. Dimension line A may extend from the bottom surface of the corresponding groove 35 to the upper surface of the tongue 20. Dimension line B may have a length of 0.33 inches in this example. Dimension line B may extend from the upper surface of the tongue 20 to the upper extreme of the added thickness portion 10. These dimensions are merely exemplary and are not intended to be limiting. Any size and shape, including relative sizes and shapes, of the present invention at these or any other dimensional measures are contemplated.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain some of the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A siding panel for stapled attachment comprising:

a tongue adapted to facilitate interconnection of said siding panel with another siding panel; and a staple hem having a predominantly planar portion that extends from said tongue to a terminal edge of said siding panel, said predominantly planar portion comprising at least one aperture configured to accommodate a staple for attaching said siding panel to a support structure;

wherein said staple hem is less than 10 mm in length; and wherein the length of said staple hem is shorter than a length of said tongue.

2. The siding panel of claim 1 further comprising an added thickness portion extending from and over said predominantly planar portion of said staple hem, said added thickness portion configured to prevent a crown of the staple from traveling through said siding panel.

3. The siding panel of claim 1 further comprising at least one exterior panel located below said tongue.

4. The siding panel of claim 3 further comprising a groove extending from said at least one exterior panel and configured to mate with a tongue of said other siding panel when interconnected.

5. The siding panel of claim 1 wherein said aperture is specifically configured to accommodate a staple fastener.

6. The siding panel of claim 1 wherein said at least one aperture is configured to receive a leg of a staple.

7. A siding panel for stapled attachment comprising:

a tongue adapted to facilitate interconnection of said siding panel with another siding panel; and a staple hem having a predominantly planar portion that extends from said tongue to a terminal edge of said siding panel, said predominantly planar portion comprising at least one aperture configured to receive a leg of a staple for attaching said siding panel to a support structure;

wherein said staple hem is less than 10 mm in length.

8. The siding panel of claim 7 wherein said length of said staple hem is shorter than a length of said tongue.

9. The siding panel of claim 7 further comprising an added thickness portion extending from and over said predominantly planar portion of said staple hem, said added thickness portion configured to prevent a crown of the staple from traveling through said siding panel.

10. The siding panel of claim 7 further comprising at least one exterior panel located below said tongue.

11. The siding panel of claim 10 further comprising a groove extending from said at least one exterior panel and configured to mate with a tongue of said other siding panel when interconnected.

12. The siding panel of claim 7 wherein said aperture is specifically configured to accommodate a staple fastener.

13. A method for installing siding, comprising:

providing a siding panel comprising:

i) a tongue adapted to facilitate interconnection of said siding panel with another siding panel; and ii) a staple hem having a predominantly planar portion that extends from said tongue to a terminal edge of said siding panel, said predominantly planar portion comprising at least one aperture configured to accommodate a staple for attaching said siding panel to a support structure;

iii) wherein said staple hem is less than 10 mm in length; and iv) wherein the length of said staple hem is shorter than a length of said tongue; and securing said siding panel to an underlying structure by installing said staple through said at least one aperture.

14. The method of claim 13 wherein:

said siding panel further comprises an added thickness portion extending from and over said predominantly planar portion of said staple hem; and a crown of said staple rests against said added thickness portion when installed.

15. The method of claim 13 wherein said siding panel further comprises at least one exterior panel located below said tongue.

16. The method of claim 15 wherein said siding panel further comprises a groove extending from said at least one exterior panel and configured to mate with a tongue of said other siding panel when interconnected.

17. The method of claim 13 wherein said aperture is specifically configured to accommodate said staple.

18. The method of claim 13 wherein a leg of said staple extends through said at least one aperture when installed.

* * * * *